US011761334B2

(12) United States Patent
Xu et al.

(10) Patent No.: US 11,761,334 B2
(45) Date of Patent: Sep. 19, 2023

(54) ENVIRONMENTAL MONITORING APPARATUS AND METHOD FOR MINE TUNNELING ROBOT

(71) Applicant: CHINA UNIVERSITY OF MINING AND TECHNOLOGY, Xuzhou (CN)

(72) Inventors: Shaoyi Xu, Xuzhou (CN); Zhencai Zhu, Xuzhou (CN); Wei Li, Xuzhou (CN); Wenting Lu, Xuzhou (CN); Gang Shen, Xuzhou (CN); Songyong Liu, Xuzhou (CN); Fangfang Xing, Xuzhou (CN); Hongxiang Jiang, Xuzhou (CN); Lei Si, Xuzhou (CN)

(73) Assignee: CHINA UNIVERSITY OF MINING AND TECHNOLOGY, Xuzhou (CN)

( * ) Notice: Subject to any disclaimer, the term of this patent is extended or adjusted under 35 U.S.C. 154(b) by 0 days.

(21) Appl. No.: 17/996,664

(22) PCT Filed: Jan. 17, 2022

(86) PCT No.: PCT/CN2022/072309
§ 371 (c)(1),
(2) Date: Oct. 20, 2022

(87) PCT Pub. No.: WO2022/161197
PCT Pub. Date: Aug. 4, 2022

(65) Prior Publication Data

US 2023/0127366 A1 Apr. 27, 2023

(30) Foreign Application Priority Data

Jan. 29, 2021 (CN) ..... 202110125404.3

(51) Int. Cl.

| | |
|---|---|
| ***E21D 9/00*** | (2006.01) |
| ***E21D 9/10*** | (2006.01) |
| ***E21C 35/24*** | (2006.01) |
| ***E21C 39/00*** | (2006.01) |

(52) U.S. Cl.
CPC ..... *E21D 9/003* (2013.01); *E21C 35/24* (2013.01); *E21C 39/00* (2013.01); *E21D 9/108* (2013.01); *E21D 9/1006* (2013.01)

(58) Field of Classification Search
CPC ..... E21D 9/003; E21D 9/087; E21D 9/10; E21D 9/1006; E21D 9/104; E21D 9/108; E21D 9/11; E21C 35/24; E21C 39/00
See application file for complete search history.

(56) References Cited

U.S. PATENT DOCUMENTS

| | | | | |
|---|---|---|---|---|
| 2010/0109418 A1 | 5/2010 | Greenspan et al. | | |
| 2011/0031017 A1* | 2/2011 | Iwata | ..... | E21B 12/02 175/40 |

(Continued)

FOREIGN PATENT DOCUMENTS

| | | | | |
|---|---|---|---|---|
| CN | 103174418 A | 6/2013 | | |
| CN | 109026021 A * | 12/2018 | ..... | E21D 9/003 |

(Continued)

OTHER PUBLICATIONS

International Search Report issued in International Patent Application No. PCT/CN2022/072309; dated Mar. 28, 2022; 4 pgs.

(Continued)

*Primary Examiner* — Abby J Flynn
*Assistant Examiner* — Michael A Goodwin
(74) *Attorney, Agent, or Firm* — HAUPTMAN HAM, LLP

(57) ABSTRACT

An apparatus includes a current excitation source, a roadheader telescopic protection cylinder, an electric rotating apparatus, auxiliary cutting teeth, a cutting head entity, a transmission shaft, an optical fiber ring protective housing, an optical fiber ring, an optical fiber current sensor control unit and a recovery electrode. The apparatus transmits an auxiliary current $I_e$ and a monitoring current $I_d$ to a coal (Continued)

seam. The auxiliary current $I_e$ and the monitoring current $I_d$ are homologous currents that are incompatible, and the auxiliary current $I_e$ squeezes the monitoring current $I_d$, so the monitoring current $I_d$ monitors the environment of the coal seam. The monitoring current $I_d$ flows to the coal seam as, and a return current $I_f$ flows through the transmission shaft and a roadheader expansion part. The optical fiber ring measures the return current $I_f$, when the roadheader is heading forward and encounters abnormal geological bodies.

10 Claims, 3 Drawing Sheets

(56) References Cited

U.S. PATENT DOCUMENTS

| | | | | |
|---|---|---|---|---|
| 2015/0233242 | A1* | 8/2015 | Li | G01S 13/885 342/22 |
| 2018/0073362 | A1* | 3/2018 | Okada | E21D 9/11 |

FOREIGN PATENT DOCUMENTS

| | | | | | |
|---|---|---|---|---|---|
| CN | 111024769 | A | | 4/2020 | |
| CN | 112324448 | A | * | 2/2021 | E21D 9/003 |
| CN | 112901159 | A | | 6/2021 | |
| DE | 102012111994 | A1 | * | 6/2014 | E21D 9/1006 |
| DE | 202019100891 | U1 | * | 4/2019 | E21D 9/003 |
| KR | 20130076907 | A | * | 7/2013 | E21D 9/10 |
| WO | WO-0017489 | A2 | * | 3/2000 | E21C 39/00 |

OTHER PUBLICATIONS

Written opinion of the International Searching Authority issued in International Patent Application No. PCT/CN2022/072309; dated Mar. 28, 2022; 11 pgs.

* cited by examiner

ENVIRONMENTAL MONITORING APPARATUS AND METHOD FOR MINE TUNNELING ROBOT

RELATED APPLICATIONS

The present application is a U.S. National Phase of International Application Number PCT/CN2022/072309, filed Jan. 17, 2022, and claims priority to Chinese Application No. 202110125404.3, filed Jan. 29, 2021.

TECHNICAL FIELD

The present disclosure relates to the technical field of coal mine monitoring technology, and in particular to an environmental monitoring apparatus and method for a mine tunneling robot.

BACKGROUND

Coal resources are the most important energy resources in China, and the tunneling of the roadway is a particularly important part in the process of coal production. However, due to the unfavorable geological conditions such as faults, non-coal pillars and gushing water, the construction conditions of roadway tunneling are complicated, the environments of roadway tunneling are harsh, and accidents occur frequently in the working area of the roadway tunneling.

In order to satisfy the requirements for the construction of intelligent mines in China, with the supports of increasingly advanced excavation equipment and monitoring technology, the requirements for safe mining of coal mines have been continuously improved. In order to ensure the personal safety of the construction personnel, it is required to provide an environmental monitoring apparatus and method with simple structure, convenient installation, convenient use, high anti-interference and high monitoring accuracy, which is suitable for the harsh environment of the roadway tunneling in the coal mines.

SUMMARY

The objectives of the present disclosure are to provide an environmental monitoring apparatus and method for a mine tunneling robot, which has a simple structure, can solve the problems of cable and optical fiber wiring, is anti-electromagnetic interference, and can monitor the environment of the geological conditions ahead in real time and with high accuracy.

In order to achieve the above-mentioned objectives, the following technical solutions are adopted in the present disclosure. The apparatus includes a current excitation source (1), a roadheader, an electric rotating apparatus (3), an optical fiber ring (8), an optical fiber current sensor control unit (9), and a recovery electrode (10).

The electric rotating apparatus (3) includes a fixing component (31) and a rotating component (32), the fixing component (31) includes a fixing component end cable (311), a brush (312) and a fixing base (313), the fixing base (313) is a main body of the fixing component (31) and is in an annular structure, the fixing component end cable (311) is connected to a side face of the fixing base (313), and the brush (312) is in a ring structure and welded on an outer circumferential surface of the fixing base (313).

The rotating component (32) includes a brush groove (321), a current aggregating plate (322), emission wires (323), auxiliary wires (324) and a rotating base (325), the rotating base (325) is a main body of the rotating component (32) and is in an annular structure, the brush groove (321) is engraved on an inner surface of the rotating base (325), the current aggregating plate (322) is in a ring structure, and the rotating base (325) is coaxially sheathed in and connected with the current aggregating plate (322).

The emission wires (323) are provided with a number of two, and are symmetrically connected to a side surface of the current aggregating plate (322), the auxiliary wires (324) are provided with a number of four, and are symmetrically connected to a side surface of the current aggregating plate (322) in pairs, the emission wires (323) and the auxiliary wires (324) are connected to the same side surface, the brush (312) of the fixing component (31) is sheathed in the brush groove (321) of the rotating component (32), and the fixing component (31) is sheathed in and fixed on a telescopic protection cylinder (2) of the roadheader;

A reflective film (81) is stuck at one end of the optical fiber ring (8), and an optical fiber pigtail (82) is led out from another end of the optical fiber ring (8).

The current excitation source (1) is connected with the fixing component (31) through the fixing component end cable (311), the auxiliary wires (324) are connected with auxiliary cutting teeth (4) of the roadheader, the emission wires (323) are connected with a cutting head entity (5) of the roadheader, the optical fiber ring (8) is wound on the telescopic protection cylinder (32) of the roadheader, and the optical fiber pigtail (82) led out from the optical fiber ring (8) is connected with the optical fiber current sensor control unit (9).

The recovery electrode (10) is driven into a roadway ground at a distance of N meters behind the roadheader, and is connected to a negative electrode of the current excitation source (1) through a cable. A magnetic field intensity generated by a return current $I_f$ can be obtained through an optical fiber ring (8) by using a Faraday effect of a magneto-optical crystal under an action of an external magnetic filed generated by the return current $I_f$, so that the value for the return current $I_f$ flowing through a transmission shaft (6) and a roadheader expansion part can be calculated.

Preferably, the recovery electrode (10) is driven into the roadway ground at a distance of 300 meters behind the roadheader, and is connected to the negative electrode of the current excitation source (1) through the cable.

Preferably, the optical fiber current sensor control unit (9) is an integration of a light source, an optical component, and a signal acquisition and processing unit.

Preferably, the current excitation source (1) is packaged together with the optical fiber current sensor control unit (9) in an electric control cabinet of the roadheader.

Preferably, the fixing base (313) of the fixing component (31) is fixedly connected to the telescopic protection cylinder (2) of the roadheader by bolts and nuts.

Preferably, an optical fiber ring protective housing (7) is connected to the telescopic protection cylinder (2) of the roadheader by bolts and nuts.

Preferably, the current aggregating plate (322) of the rotating component (32) is fixedly connected to an inner wall of the cutting head entity (5) by bolts and nuts.

Preferably, the optical fiber ring protective housing (7) is connected to the telescopic protection cylinder (2) of the roadheader, and the optical fiber ring (8) is wound on the telescopic protection cylinder (2) of the roadheader and located in the optical fiber ring protective housing (7).

The present disclosure further provides a method for monitoring environment implemented by an environmental monitoring apparatus for a mine tunneling robot, wherein the method includes the following steps.

A, a current excitation source (1) is set to emit a constant current I, the constant current I is transmitted to a fixing base (313) through a fixing component end cable (311), then the constant current I is transmitted into a rotating base (325) through a frictional contact between a brush (312) and a brush groove (321), and subsequently the constant current I is aggregated by the current aggregating plate (322) to transmit the constant current I into auxiliary wires (324) and emission wires (323), the constant current I is shunted by the auxiliary wires (324) and the emission wires (323) to form an auxiliary current $I_e$ and an emission current $I_s$, where $I=I_e+I_s$, the auxiliary current $I_e$ is driven into a coal seam through auxiliary cutting teeth (4) connected with the auxiliary wires (324), the emission current $I_s$ is transmitted to a cutting head entity (5) through the emission wires (323), the emission current $I_s$ in the cutting head entity (5) is shunted into a monitoring current $I_d$ and a return current $I_f$, where $I_s=I_d+I_f$, the monitoring current $I_d$ is driven into the coal seam, the return current $I_f$ is returned to a negative electrode of the current excitation source (1) through a transmission shaft (6) and a roadheader expansion part, and a stray current $I_x$ formed by the auxiliary current $I_e$ and the monitoring current $I_d$ in the coal seam is returned to a recovery electrode (10).

B, a magnetic field intensity generated by the return current $I_f$ is obtained through an optical fiber ring (8) by using Faraday effect of a magneto-optical crystal under an action of an external magnetic filed generated by the return current $I_f$ to calculate a value for the return current $I_f$, in a case where a value for the emission current $I_s$ flowing through the emission wires (323) is known and the value for the emission current $I_s$ keeps constant, wherein, when the roadheader robot is initially heading forward, and no abnormal geological body exists in a front of the roadheader robot, and the measured return current $I_f$ is a reference value, which is denoted as $I_{f0}$.

C, the value for the return current $I_f$ is monitored in real time when the roadheader robot continues heading forward, it is determined that a coal seam in the front of the roadheader robot is a low-resistivity body containing water, in a case where when the value for the return current $I_f$ monitored in real time is less than $I_{f0}$, a value for the monitoring current $I_d$ becomes larger, that is, a resistance of the coal seam in the front of the roadheader becomes smaller, and it is determined that the coal seam in the front of the roadheader robot is a high resistivity body containing faults, in a case where when the value for the return current $I_f$ monitored in real time is greater than $I_{f0}$, the value for the monitoring current $I_d$ becomes smaller, that is, the resistance of the coal seam in the front of the roadheader robot becomes larger, thereby implementing a monitoring on the environment in the front of the roadheader robot.

Preferably, the fixing component (31) is connected and fixed with the telescopic protection cylinder (2) of the roadheader, the rotating component (32) rotates together with the cutting head entity (5).

Preferably, the auxiliary current $I_e$ and the monitoring current $I_d$ are homologous currents that are incompatible with each other, so that the monitoring current $I_d$ is squeezed by the auxiliary current $I_e$ flowing out from the auxiliary cutting teeth (4).

Preferably, the environment monitoring can be performed on a front, left and right fronts by adjusting the magnitude ratio of the auxiliary current $I_e$ to the monitoring current $I_d$.

Preferably, the current excitation source (1) is a constant-current power supply and a value for an output current is in a range from 0 mA to 1000 mA.

Preferably, a value for the emission current $I_s$ flowing out from the emission wires (323) is constant and is larger than or equal to 300 mA.

Preferably, the optical fiber ring (8) is a rotating high-birefringence fiber that is insensitive to vibration, and measures the value for the return current $I_f$.

Compared with the prior art, the technical solutions of the present disclosure has the following beneficial effects.

The present disclosure provides a large-diameter electric rotating apparatus suitable for a mine hoist, the fixing component is fixed and the rotating component is rotated with the cutting head entity, which can effectively solve the problem of cable and optical fiber wiring. In the present disclosure, the return current $I_f$ flowing to the transmission shaft and the roadheader extension part is measured by the optical fiber ring, which can simply and effectively implement the resistance measurement on coal seams facing different geological conditions. The present disclosure has the advantages of anti-electromagnetic interference and monitoring the environment of the geological conditions ahead in real time and with high accuracy. This method has a simple structure, and can solve the problems of cable and optical fiber wiring, is anti-electromagnetic interference, and can monitor the environment of the geological conditions ahead in real time and with high accuracy.

Figure 1:
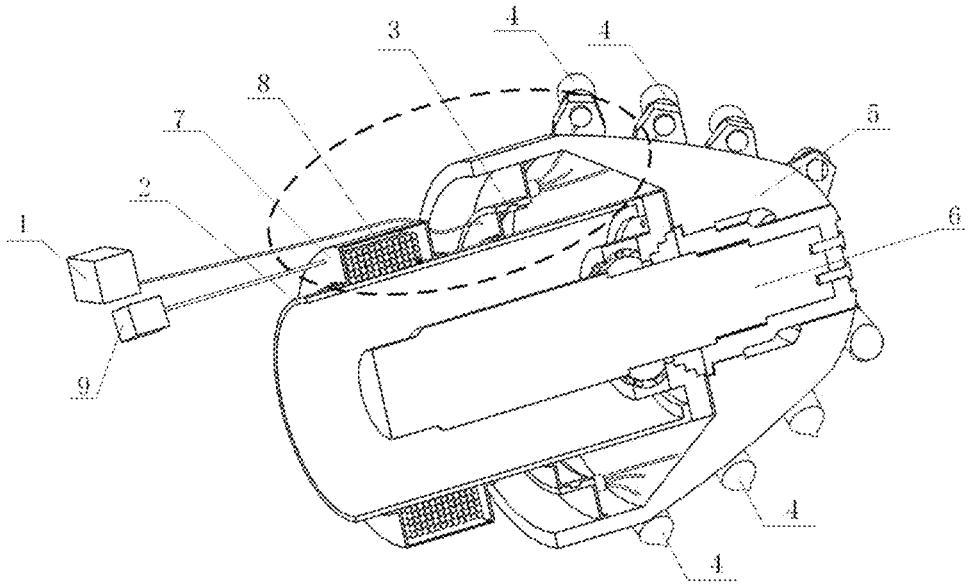
FIG. 1 illustrates a schematic diagram of an overall arrangement of an environmental monitoring apparatus utilized in the present disclosure.

Reference numerals: 1. Current excitation source; 2. Telescopic protection cylinder of the roadheader; 3. Electric rotating apparatus; 31. Fixing component; 311. Fixing component end cable; 312. Brush; 313. Fixing base; 32. Rotating component; 321. Brush groove; 322. Current aggregating plate; 323. Emission wire; 324. Auxiliary wire; 325. Rotating base; 4. Auxiliary cutting tooth; 5. Cutting head entity; 6. Transmission shaft; 7. Optical fiber protective housing; 8. Optical fiber ring; 81. Reflective film; 82. Optical fiber pigtail; 9. Optical fiber current sensor control unit; 10. Recovery electrode.

DETAILED DESCRIPTION OF THE EMBODIMENTS

The present disclosure will be further described in detail below with reference to the accompanying drawings and specific embodiments.

Figure 2:
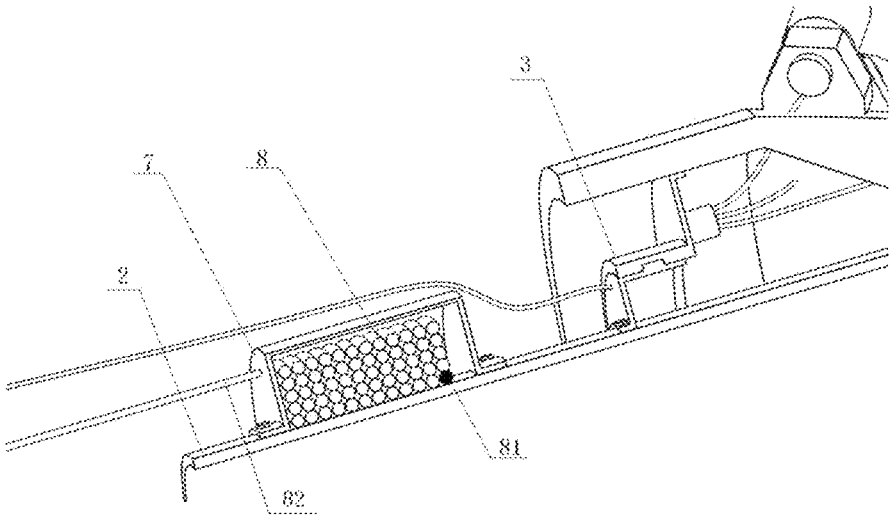
FIG. 2 illustrates a partial schematic diagram of the environmental monitoring apparatus utilized in the present disclosure.
Figure 3:
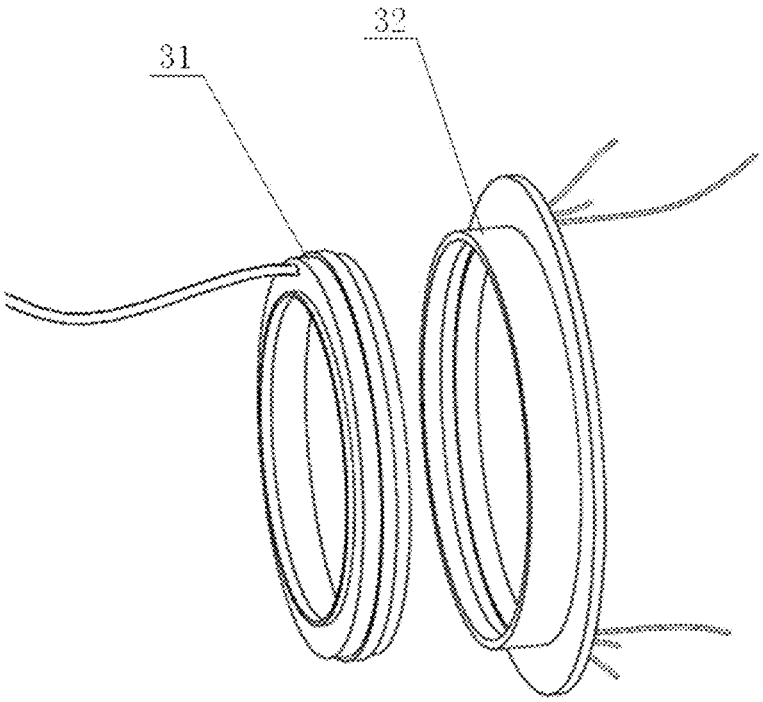
FIG. 3 illustrates an overall schematic diagram of an electric rotating apparatus of the present disclosure.
Figure 4:
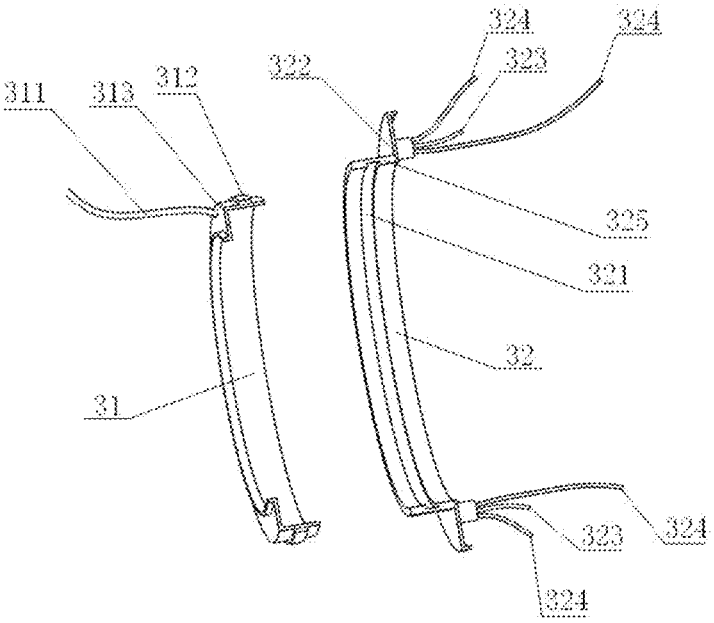
FIG. 4 illustrates a partial cross-sectional view of the electric rotating apparatus of the present disclosure.
Figure 5:
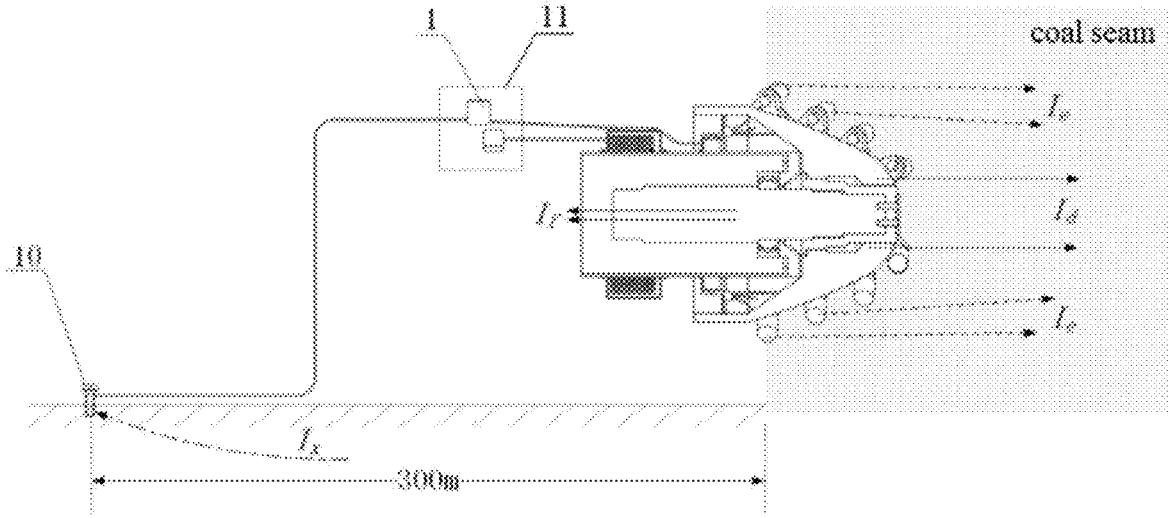
FIG. 5 illustrates a working schematic diagram of the environment monitoring apparatus of the present disclosure in a roadway.

The present disclosure provides an environmental monitoring apparatus and method for a mine tunneling robot. As illustrated in FIG. 1, FIG. 2, FIG. 3, FIG. 4 and FIG. 5, the apparatus includes a current excitation source (1), a roadheader, an electric rotating apparatus (3), an optical fiber ring protective housing (7), an optical fiber ring (8), an optical fiber current sensor control unit (9) and a recovery electrode (10).

The present disclosure provides an environmental monitoring apparatus for a mine tunneling robot. The apparatus includes a current excitation source (1), a roadheader, an electric rotating apparatus (3), an optical fiber ring (8), an optical fiber current sensor control unit (9) and a recovery electrode (10).

The electric rotating apparatus (3) includes a fixing component (31) and a rotating component (32). The fixing component (31) includes a fixing component end cable (311), a brush (312) and a fixing base (313). The fixing base (313) is a main body of the fixing component (31) and is in an annular structure. The fixing component end cable (311) is connected to a side face of the fixing base (313), and the brush (312) is in a ring structure and welded on an outer circumferential surface of the fixing base (313).

The rotating component (32) includes a brush groove (321), a current aggregating plate (322), emission wires (323), auxiliary wires (324) and a rotating base (325). The rotating base (325) is a main body of the rotating component (32) and is in an annular structure. The brush groove (321) is engraved on an inner surface of the rotating base (325). The current aggregating plate (322) is in a ring structure, and the rotating base (325) is coaxially sheathed in and connected with the current aggregating plate (322).

The emission wires (323) are provided with a number of two, and are symmetrically connected to a side surface of the current aggregating plate (322). The auxiliary wires (324) are provided with a number of four, and are symmetrically connected to a side surface of the current aggregating plate (322) in pairs, and the emission wires (323) and the auxiliary wires (324) are connected on the same side surface. The brush (312) of the fixing component (31) is sheathed in the brush groove (321) of the rotating component (32), and the fixing component (31) is sheathed in and fixed on a telescopic protection cylinder (2) of the roadheader.

A reflective film (81) is stuck at one end of the optical fiber ring (8), and an optical fiber pigtail (82) is led out from another end of the optical fiber ring (8).

The current excitation source (1) is connected with the fixing component (31) through the fixing component end cable (311). The auxiliary wires (324) are connected with auxiliary cutting teeth (4) of the roadheader. The emission wires (323) are connected with a cutting head entity (5) of the roadheader. The optical fiber ring (8) is wound on the telescopic protection cylinder (32) of the roadheader, and the optical fiber pigtail (82) led out from the optical fiber ring (8) is connected with the optical fiber current sensor control unit (9).

The recovery electrode (10) is driven into a roadway ground at a distance of N meters behind the roadheader, and is connected to a negative electrode of the current excitation source (1) through a cable. A magnetic field intensity generated by a return current $I_f$ can be obtained through an optical fiber ring (8) by using the Faraday effect of a magneto-optical crystal under an action of the external magnetic filed generated by the return current $I_f$, so that the value for the return current $I_f$ flowing through a transmission shaft (6) and a roadheader expansion part can be calculated.

Preferably, the recovery electrode (10) is driven into the roadway ground at a distance of 300 meters behind the roadheader, and is connected to the negative electrode of the current excitation source (1) through the cable.

Preferably, the optical fiber current sensor control unit (9) is an integration of a light source, an optical component, and a signal acquisition and processing unit.

Preferably, the current excitation source (1) is packaged together with the optical fiber current sensor control unit (9) in an electric control cabinet of the roadheader.

Preferably, the fixing base (313) of the fixing component (31) is fixedly connected to the telescopic protection cylinder (2) of the roadheader by bolts and nuts.

Preferably, an optical fiber ring protective housing (7) is connected to the telescopic protection cylinder (2) of the roadheader by bolts and nuts.

Preferably, the current aggregating plate (322) of the rotating component (32) is fixedly connected to an inner wall of the cutting head entity (5) by bolts and nuts.

Preferably, the optical fiber ring protective housing (7) is connected to the telescopic protection cylinder (2) of the roadheader, and the optical fiber ring (8) is wound on the telescopic protection cylinder (2) of the roadheader and located in the optical fiber protective housing (7).

The present disclosure further provides a method for monitoring the environment implemented by the environmental monitoring apparatus for the mine tunneling robot, wherein the method includes the following steps.

A, a current excitation source (1) is set to emit a constant current I, the constant current I is transmitted to the fixing base (313) by the fixing component end cable (311), then the constant current I is transmitted into the rotating base (325) through a frictional contact between a brush (312) and a brush groove (321), and subsequently the constant current I is aggregated by the current aggregating plate (322) to transmit the constant current I into auxiliary wires (324) and emission wires (323). The constant current I is shunted by the auxiliary wires (324) and the emission wires (323) to form an auxiliary current $I_e$ and an emission current $I_s$, where $I=I_e+I_s$. The auxiliary current $I_e$ is driven into a coal seam through auxiliary cutting teeth (4) connected with the auxiliary wires (324). The emission current $I_s$ transmitted to the cutting head entity (5) through the emission wires (323). The emission current $I_s$ in the cutting head entity (5) is shunted into a monitoring current $I_d$ and a return current $I_f$, where $I_s=I_d+I_f$. The monitoring current $I_d$ is driven into the coal seam. The return current $I_f$ is return to a negative electrode of the current excitation source (1) through a transmission shaft (6) and a roadheader expansion part, and a stray current $I_x$ formed by the auxiliary current $I_e$ and the monitoring current $I_d$ in the coal seam is return to the recovery electrode (10).

B, a magnetic field intensity generated by the return current $I_f$ is obtained through the optical fiber ring (8) by using the Faraday effect of a magneto-optical crystal under an action of an external magnetic filed generated by the return current $I_f$ to calculate a value for the return current $I_f$, in a case where a value for the emission current $I_s$ flowing through the emission wires (323) is known and the value for the emission current $I_s$ keeps constant, wherein, when the roadheader robot is initially heading forward, and no abnormal geological body exists in a front of the roadheader robot, and the measured return current $I_f$ is a reference value, which is denoted as $I_{f0}$.

C, the value for the return current $I_f$ is monitored in real time when the roadheader robot continues heading forward, it is determined that a coal seam in the front of the roadheader robot is a low-resistivity body containing water, in a case where when the value for the return current $I_f$ monitored in real time is less than $I_{f0}$, the value for the monitoring current $I_d$ becomes larger, that is, a resistance of the coal seam in the front of the roadheader becomes smaller, and it is determined that the coal seam in the front of the roadheader robot is a high resistivity body containing faults, in a case where when the value for the return current $I_f$ monitored in real time is greater than $I_{f0}$, the value for the monitoring current $I_d$ becomes smaller, that is, the resistance of the coal seam in the front of the roadheader robot becomes larger, thereby implementing a monitoring on the environment in the front of the roadheader robot.

Preferably, the fixing component (31) is connected and fixed with the telescopic protection cylinder (2) of the roadheader, the rotating component (32) rotates together with the cutting head entity (5).

Preferably, the auxiliary current $I_e$ and the monitoring current $I_d$ are homologous currents that are incompatible with each other, so that the monitoring current $I_d$ is squeezed by the auxiliary current $I_e$ flowing out from the auxiliary cutting teeth (4).

Preferably, the environment monitoring can be performed on a front, left and right fronts by adjusting the magnitude ratio of the auxiliary current $I_e$ to the monitoring current $I_d$.

Preferably, the current excitation source (1) is a constant-current power supply and a value for an output current is in a range from 0 mA to 1000 mA.

Preferably, a value for the emission current $I_s$ flowing out from the emission wires (323) is constant and is larger than or equal to 300 mA.

Preferably, the optical fiber ring (8) is a rotating high-birefringence fiber that is insensitive to vibration, and measures the value for the return current $I_f$.

The above are merely preferred embodiments of the present disclosure, and are intended to limit the present disclosure in any form. Based on the embodiments of the present disclosure, all other embodiments obtained by those of ordinary skilled in the art without creative effort belong to the protection scope of the present disclosure. Any simple modifications or equivalent changes made to the above embodiments according to the technical essence of the present disclosure all fall within the protection scope of the present disclosure.

What is claimed is:

1. An environmental monitoring apparatus for a mine tunneling robot, wherein the apparatus comprises: a current excitation source, a roadheader, an electric rotating apparatus, an optical fiber ring, an optical fiber current sensor control unit, and a recovery electrode;

the electric rotating apparatus includes a fixed component and a rotating component, the fixed component includes a fixed component end cable, a brush and a fixing fixed base, the fixed base is a main body of the fixed component and is in an annular structure, the fixed component end cable is connected to a side face of the fixed base, and the brush is in a ring structure and welded on an outer circumferential surface of the fixed base;

the rotating component includes a brush groove, a current aggregating plate, emission wires, auxiliary wires and a rotating base, the rotating base is a main body of the rotating component and is in an annular structure, the brush groove is located on an inner surface of the rotating base, the current aggregating plate is in a ring structure, and the rotating base is coaxially received in and connected with the current aggregating plate;

the emission wires are provided with a number of two, and are symmetrically connected to a side surface of the current aggregating plate, the auxiliary wires are provided with a number of four, and are symmetrically connected to the side surface of the current aggregating plate in pairs, the emission wires and the auxiliary wires are connected to the same side surface, the brush of the fixed component is received in the brush groove of the rotating component, and the fixed component is received in and fixed on a telescopic protection cylinder of the roadheader;

a reflective film is coated at one end of the optical fiber ring, and an optical fiber pigtail is led out from another end of the optical fiber ring;

the current excitation source is connected with the fixed component through the fixed component end cable, the auxiliary wires are connected with auxiliary cutting teeth of the roadheader, the emission wires are connected with a cutting head body of the roadheader, the optical fiber ring is wound on the telescopic protection-cylinder of the roadheader, and the optical fiber pigtail led out from the optical fiber ring is connected with the optical fiber current sensor control unit; and the recovery electrode is driven into a roadway ground surface at a distance behind the roadheader, and is connected to a negative electrode of the current excitation source through a cable.

2. The environmental monitoring apparatus for the mine tunneling robot according to claim 1, wherein the optical fiber current sensor control unit is an integration of a light source, an optical component, and a signal acquisition and processing unit.

3. The environmental monitoring apparatus for the mine tunneling robot according to claim 1, wherein the current excitation source and the optical fiber current sensor control unit are configured in an electric control cabinet of the roadheader.

4. The environmental monitoring apparatus for the mine tunneling robot according to claim 1, wherein the fixed base of the fixed component is fixedly connected to the telescopic protection cylinder of the roadheader by bolts and nuts.

5. The environmental monitoring apparatus for the mine tunneling robot according to claim 1, wherein an optical fiber protective housing is connected to the telescopic protection cylinder of the roadheader by bolts and nuts.

6. The environmental monitoring apparatus for the mine tunneling robot according to claim 1, wherein the current aggregating plate of the rotating component is fixedly connected to an inner wall of the cutting head body by bolts and nuts.

7. The environmental monitoring apparatus for the mine tunneling robot according to claim 1, wherein an optical fiber protective housing is connected to the telescopic protection cylinder of the roadheader, and the optical fiber ring is wound on the telescopic protection cylinder of the roadheader and located in the optical fiber protective housing.

8. A method for monitoring an environment implemented by the environmental monitoring apparatus for the mine tunneling robot according to claim 1, wherein the method comprises following steps:

A, setting the current excitation source to emit a constant current (I), transmitting the constant current (I) to the fixed base through the fixed component end cable, then transmitting, through a frictional contact between the brush and the brush groove, the constant current (I) into the rotating base subsequently aggregating the constant current (I) by the current aggregating plate to transmit the constant current (I) into the auxiliary wires and the emission wires, shunting the constant current (I) by the auxiliary wires and the emission wires to form an auxiliary current ($I_e$) and an emission current ($I_s$), where $I=I_e+I_s$, driving the auxiliary current ($I_e$) into a coal seam through the auxiliary cutting teeth connected with the auxiliary wires, transmitting the emission current ($I_s$) to the cutting head body through the emission wires, shunting the emission current ($I_s$) in the cutting head body into a monitoring current ($I_d$) and a return current ($I_f$) where $I_s=I_d+I_f$, driving the monitoring current ($I_d$) into the coal seam, returning the return current ($I_f$) to the negative electrode of the current excitation source through a transmission shaft and a telescopic structure of the roadheader, and returning a stray current ($I_y$) formed by the auxiliary current ($I_e$) and the monitoring current ($I_d$) in the coal seam to the recovery electrode;

B, obtaining, in a case where a value for the emission current ($I_s$) flowing through the emission wires is known and the value for the emission current ($I_s$) keeps constant, a magnetic field intensity generated by the return current ($I_f$) through the optical fiber ring by using Faraday effect of a magneto-optical crystal under an action of an external magnetic field generated by the return current ($I_f$), thereby calculating a value for the return current ($I_f$), wherein, when a roadheader robot is initially heading forward, and no abnormal geological body exists in a front of the roadheader robot, and the measured return current ($I_f$) is a reference value, denoted as ($I_{f0}$); and C, monitoring, when the roadheader robot continues heading forward, the value for the return current ($I_f$) in real time, determining that a coal seam in the front of the roadheader robot is a low-resistivity body containing water, in a case where when the value for the return current ($I_f$) monitored in real time is less than ($I_{f0}$), a value for the monitoring current ($I_d$) becomes larger, that is, a resistance of the coal seam in the front of the roadheader robot becomes smaller, and determining that the coal seam in the front of the roadheader robot is a high resistivity body containing faults, in a case where when the value for the return current ($I_d$) monitored in real time is greater than ($I_{f0}$), the value for the monitoring current ($I_d$) becomes smaller, that is, the resistance of the coal seam in the front of the roadheader robot becomes larger, thereby implementing a monitoring on the environment in the front of the roadheader robot.

9. The method for monitoring the environment according to claim 8, wherein the current excitation source is a constant-current power supply and a value for an output current is in a range from 0 mA to 1000 mA.

10. The method for monitoring the environment according to claim 8, wherein the value for the emission current ($I_s$) flowing out from the emission wires is constant and is larger than or equal to 300 mA.

* * * * *